United States Patent [19]

Halvorsen

[11] Patent Number: 4,938,417

[45] Date of Patent: Jul. 3, 1990

[54] AIRBLAST FUEL INJECTOR WITH TUBULAR METERING VALVE

[75] Inventor: Robert M. Halvorsen, Birmingham, Mich.

[73] Assignee: Fuel Systems Textron Inc., Walled Lake, Mich.

[21] Appl. No.: 336,773

[22] Filed: Apr. 12, 1989

[51] Int. Cl.[5] ..... B05B 7/10; B05B 7/06

[52] U.S. Cl. ..... 239/5; 239/406; 239/410; 239/424.5; 239/533.2; 239/533.6; 123/531; 123/590; 137/850; 251/158; 60/741

[58] Field of Search ..... 239/400, 402, 405, 406, 239/408, 410, 413, 412, 416.5, 417.3, 424.5, 533.1, 533.2, 533.6, 533.13, 570, 571, 410, 424, 533.4; 137/843, 850; 251/158, 170; 123/531, 590; 60/740–742

[56] References Cited

U.S. PATENT DOCUMENTS

| | | | |
|---|---|---|---|
| 2,107,998 | 2/1938 | Rullison | 251/119 |
| 2,144,874 | 1/1939 | Edwards | 239/533.4 |
| 2,574,865 | 11/1951 | Edwards | 299/118 |
| 2,893,647 | 7/1959 | Wortman | 239/464 |
| 3,310,240 | 3/1967 | Grundman | 239/404 |
| 3,598,321 | 8/1971 | Bobzin | 239/400 |
| 3,684,186 | 8/1972 | Helmrich | 239/400 |
| 3,980,233 | 9/1976 | Simmons et al. | 239/406 |
| 4,170,108 | 10/1979 | Mobsby | 239/406 |
| 4,512,514 | 4/1985 | Elcott | 239/533.1 |
| 4,600,151 | 7/1986 | Bradley | 239/406 |
| 4,638,636 | 1/1987 | Cohen | 60/741 |
| 4,754,922 | 7/1988 | Halvorsen et al. | 239/5 |
| 4,815,664 | 3/1989 | Tuthill et al. | 239/406 |
| 4,841,725 | 6/1989 | Farris | 60/741 |

FOREIGN PATENT DOCUMENTS 1775973 5/1973 Fed. Rep. of Germany .

*Primary Examiner*—Andres Kashnikow
*Assistant Examiner*—Christopher G. Trainor
*Attorney, Agent, or Firm*—Edward J. Timmer

[57] ABSTRACT

An airblast fuel injector tip is provided for reducing fuel vaporization problems as a result of high fuel temperatures without adversely affecting the airblast operational characteristics of the injector tip. The injector tip includes a fuel receiving chamber and a fuel discharge orifice downstream thereof and an arcuate, distensible, tubular valve member having a discharge end movable relative to a valve seat in the fuel receiving chamber in dependence on the pressure of fuel in the valve member to meter fuel to the fuel receiving chamber for discharge through the discharge orifice into a combustor.

19 Claims, 1 Drawing Sheet

AIRBLAST FUEL INJECTOR WITH TUBULAR METERING VALVE

FIELD OF THE INVENTION

The invention relates to fuel injector constructions especially for gas turbine engines and methods for vapor lock prevention and, in particular, to airblast fuel injector constructions having a special valving configuration in the injector tip near the injector discharge end for providing a high fuel pressure drop to reduce fuel vaporization resulting from high temperatures.

BACKGROUND OF THE INVENTION

U.S. Pat. No. 3,684,186 issued Aug. 16, 1972, to William F. Helmrich discloses in FIG. 2 a known airblast fuel injector for gas turbine engines wherein the injector has generally concentric chambers for inner and outer air flows and intermediate fuel flow and generally concentric discharge orifices for discharging and intermixing inner and outer air flows and the fuel flow. U.S. Pat. No. 3,980,233 issued Sept. 14, 1976, to Harold C. Simmons illustrates an airblast fuel injector of similar construction for a gas turbine engine. Because of the typical low pressure drop of a prior art airblast type injector, such airblast injector has employed a fuel metering valve in a housing on the opposite end of an injector support strut considerably upstream from the injector tip and outside the combustor case to compensate for pressure head effects and provide adequate fuel distribution to the engine combustor. As a result, fuel back pressure is maintained only to a valve which is considerably upstream from the injector tip. The low fuel back pressure at the airblast injector tip, actually from the remote upstream fuel valve to the injector tip, makes the fuel downstream of the valve prone to vaporization when fuel temperature increases as explained in the next paragraph. In addition, the fuel passages downstream from the metering valve to the injector tip are circuitous and often small in size, being prone to vapor lock with adverse consequences as will be explained in the next paragraph.

As mentioned in U.S. Pat. No. 4,754,922, there has been an effort to increase the power (thrust) and efficiency of gas turbine engines especially for military use by raising operating temperature of the hot gas generated in the combustor for subsequent flow to the turbine and past the engine outlet. Although airblast fuel injectors of the type shown in FIG. 2 of the Helmrich U.S. Pat. No. 3,684,186 have performed satisfactorily in the current gas turbine engine where fuel temperature is about 250° F. at the injector tip, initial tests of the same fuel injectors in higher temperature engines where fuel temperature at the injector tip is within the range of 300° F. to 400° F. have evidenced a problem of fuel vaporization in the fuel passages downstream from the fuel metering valve and at the injector tip from the higher temperatures involved. The fuel vaporization results in vapor lock condition in the fuel passages causing pulsing or intermittent interruptions in fuel flow from the injector which in turn causes combustion instability and adversely affects operation of the engine.

Aforementioned U.S. Pat. No. 4,754,922 describes an airblast fuel injector and method for reducing fuel vaporization in an airblast fuel injector tip by positioning a cantilever spring fuel metering valve at an upstream axial location relative to the fuel discharge orifice to reduce fuel vaporization upstream of the valve location and yet provide for formation of a fuel stream amenable to the airblast effect of the inner air stream such that the airblast operational characteristics of the injector are not adversely affected.

U.S. Pat. No. 3,598,321 issued Aug. 10, 1971, to Darrel G. Bobzin illustrates a fuel injector construction for a gas turbine engine having multiple rectilinear leaf spring valves carried on a cylindrical valve plate with each leaf spring valve received in a chordal type slot in the valve plate for controlling fuel flow between cylindrical passages extending from the outer periphery to an inner cylindrical bore in the valve plate. However, the fuel injector disclosed is not an airblast fuel injector and is not exposed to higher fuel temperatures associated with recently developed engines.

U.S. Pat. No. 2,107,998 issued Feb. 8, 1938, to E. A. Rullison describes an air valve carburation device wherein a flexible annular reed valve is held on a supporting disk and against a valve seat to control air flow to an engine and is opened by a vacuum condition in the carburetor.

SUMMARY OF THE INVENTION

The invention contemplates a fuel injector tip useful for reducing fuel vaporization at elevated fuel temperatures. The fuel injector tip includes a fuel receiving chamber and a fuel discharge orifice downstream of the chamber, a valve seat disposed in the fuel receiving chamber and an arcuate, distensible, tubular valve member for receiving pressurized fuel therein from a source, such as for example a fuel supply inlet on the injector tip. The tubular valve member includes a stationary inlet end in fuel flow communication with the source of fuel and a discharge end disposed in the fuel receiving chamber and cooperatively movable relative to the valve seat in dependence upon the pressure of the fuel in the valve member in such a manner as to control discharge of fuel from the valve member to the fuel receiving chamber.

The tubular valve member includes an arcuate bend and wall thickness selected to provide a desired valve spring rate for maintaining the valve and valve seat in a closed relationship below a selected fuel pressure and in an open fuel metering relation above the selected fuel pressure to meter fuel flow to the fuel receiving chamber.

In a typical working embodiment of the invention, an airblast fuel injector tip of the invention includes injector body means for forming an inner air chamber having a downstream inner air discharge, an outer air chamber having a downstream outer air discharge orifice and an annular fuel chamber between the inner and outer air chambers and having a downstream fuel discharge orifice. The injector tip also includes a valve seat in the fuel receiving chamber and an arcuate, distensible, tubular valve member for receiving pressurized fuel therein from the source and having the aforementioned discharge end cooperatively movable relative to the valve seat in dependence on the pressure of fuel in the valve member to control discharge of the fuel from inside the valve member to the fuel receiving chamber. Typically, the inlet end of the tubular valve member is fixedly attached to the injector body and communicates with a fuel supply inlet in the injection body.

In a preferred embodiment of the invention, the valve seat is adjustably mounted on the injector body and is accessible exteriorly of the injector body for adjustment of the cracking or opening pressure (i.e., fuel pressure) of the tubular valve member. The valve seat may include a male seating and metering portion (e.g., a conical shaped sealing and metering portion) adapted to be received in the discharge end of the tubular valve member.

DESCRIPTION OF PREFERRED EMBODIMENTS

Figure 1:
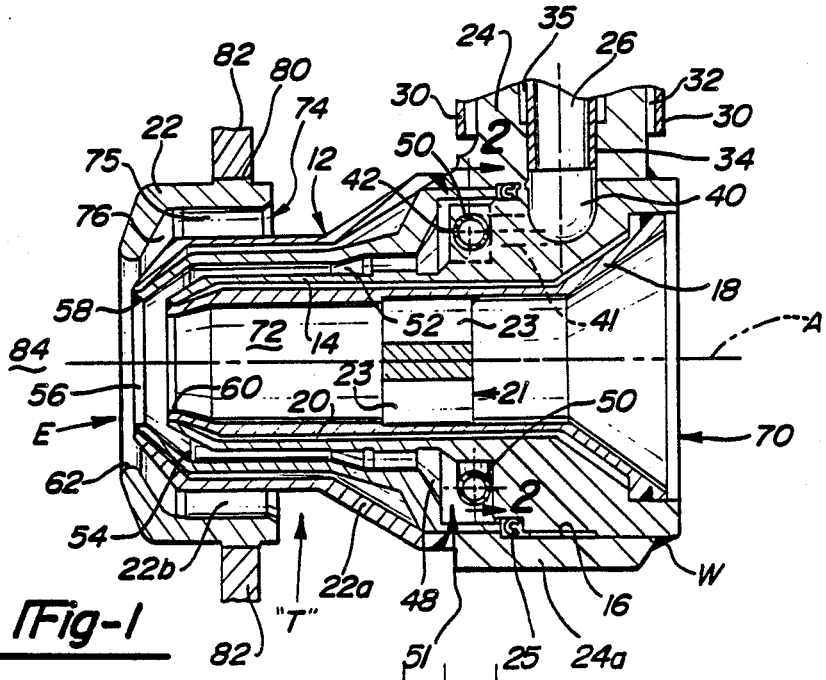
FIG. 1 is a longitudinal cross-sectional view through an airblast fuel injector tip of the invention.
Figure 2:
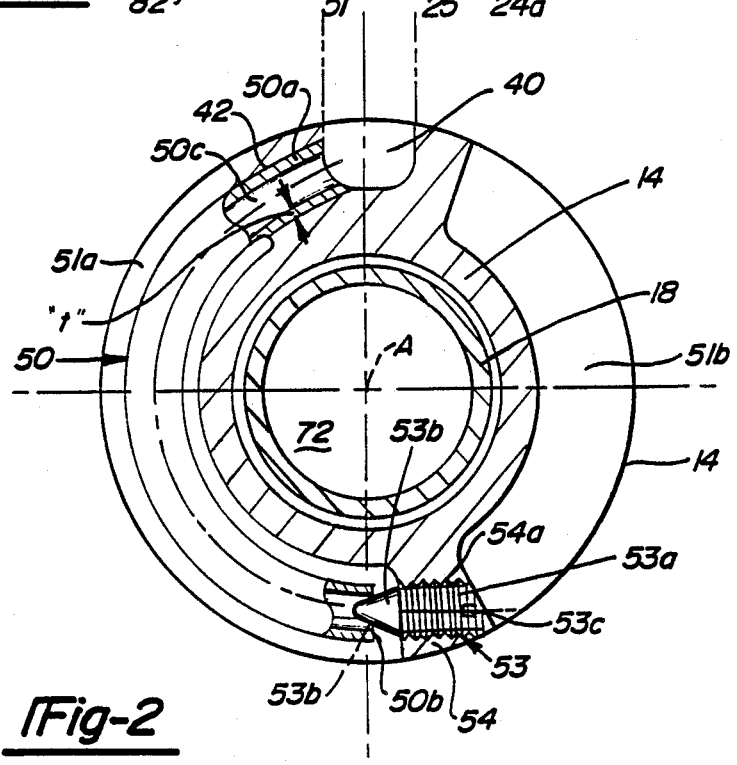
FIG. 2 is a sectional view of the fuel injector tip taken along lines 2—2 of FIG. 1.

FIGS. 1-2 illustrate an airblast type of fuel injector for a higher temperature gas turbine engine with an injector tip T constructed in accordance with the invention to provide higher fuel pressure drop and reduced fuel vaporization from fuel temperatures in the general range of 300° F. to 400° F. at the injector tip.

The fuel injector tip includes an outer injector body 12 and inner injector body 14 with the latter received in a longitudinal bore 16 in the former. A tubular heat shield body 18 is attached as by welding or other means inside the inner injector body 14 to provide a heat insulating dead air space 20. An air swirler member 21 having swirl vanes 23 is disposed fixedly in the heat shield body 18. A tubular outer shroud 22 having inner tubular wall **22*a* (forming part of the outer injector body 12) and air swirl vanes 22*b* is attached as by welding or other means on the tubular portion 24*a* of the support strut 24 (forming the remainder of the outer injector body 12) for purposes to be explained. A C-shaped fuel seal 25 is provided between tubular portion 24*a* and the inner injector body 14** to prevent fuel leakage.

As is apparent, the outer injector body 12 and inner injector body 14 are tubular in shape. Outer injector body 12 includes the tubular portion or extension **24*a* on the support strut 24. The support strut 24 includes a fuel passage 26 for receiving pressurized fuel from a fuel pump (not shown) in known manner. As is known, the support strut 24 includes a mounting flange at the end opposite from the fuel injector tip for attachment to a casing of the engine to support the injector tip as shown in FIG. 1 relative to the combustor 84 and terminates at the opposite end in a fitting for connection to a fuel line. An external heat shield 30 is attached around extension 24 to provide air space 32. Similarly, an internal heat shield sleeve 34 is attached in fuel passage 26 to provide heat insulating air space 35**.

The inner and outer injector bodies 12,14 include generally cylindrical cross-section tubular portions along their lengths extending toward the discharge end E of the fuel injector, the cylindrical portions being generally concentric relative to longitudinal axis A of the injector. As will be described, various fuel chambers and passages are formed between the nested cylindrical portions of the inner and outer injector bodies 12,14 and shroud 22.

In FIG. 1, inner and outer injector bodies 12,14 define a fuel inlet chamber 40 machined predominantly in the inner injector body with fuel inlet chamber 40 being in fuel flow relation to fuel passage 26 to receive fuel therefrom.

The inner injector body 14 includes an axial fuel passage 41 extending downstream of the fuel inlet chamber 40, FIG. 1, into intersection with a circumferentially extending fuel passage 42, FIG. 2. Fuel flows from the fuel inlet chamber 40 through passages 41,42 into an arcuate, distensible, tubular valve member 50 received in an arcuately scalloped out, fuel receiving chamber portion **51*a* of the inner injector body 14, FIG. 2**.

The tubular valve member 50 includes a stationary open inlet end **50*a* affixed in the passage 42 and an open discharge end 50*b* cooperatively positioned relative to a valve seat 53 adjustably disposed in an arcuately, scalloped out fuel receiving chamber portion 51*b* of the inner injector body 14, FIG. 2. The valve seat 53 includes a threaded end 53*a* received in a threaded bore 54*a* of a web extension 54 of the inner injector body 14. The web-extension 54 is formed between the fuel receiving portions 51*a*,51*b*, which together define a fuel receiving chamber 51 into which pressurized fuel is discharged from the discharge end 50*b*** when it opens as will be explained herebelow.

The tubular valve member 50 typically is made of a high temperature metal heat treatable to exhibit desired spring characteristics under the expected conditions of operation, such as RENE 41 or WASPALOY superalloy. The extent or degree of bend as well as the wall thickness "t" of the tubular valve member 50 is selected to provide a desired valve spring rate to control the fuel flow rate from injector tip "T" in accordance with a prescribed fuel flow schedule. In particular, the spring rate or bias is selected to initially bias the discharge end **50*b* closed against the male seating/metering portion 53*b* of the valve seat 53 until a desired minimum fuel pressure is reached for valve cracking or opening. Once fuel pressure increases above the minimum fuel pressure, the tubular valve member 50 is caused to distend by the pressure of the fuel in the passage 50*c* as controlled by the spring rate of the valve member. Distention of the valve member 50 results in movement of the discharge end 50*b* thereof away from the seating/metering portion 53*b* to a valve metering (valve open) condition relative to the male seating portion 53*b*. As fuel pressure continues to increase and distend the valve member 50, the discharge end 50*b* is caused to move relative to the seating/metering portion 53*b* in such a manner as to meter fuel flow into the fuel receiving chamber 51** in a predetermined relationship of fuel flow rate with fuel pressure throughout the operational fuel flow range of the injector tip "T".

The fuel pressure required to initially crack or open the discharge end **50*b* of the valve member 50 is adjusted by threading the valve seat 53 toward or away from the discharge end 50*b* to vary the spring bias of valve member against the male seating portion 53*b*. The valve seat 53 is adjusted exteriorly of the inner injector body 14 using a screw driver or other suitable tool engaging a tool slot 53*c* in the outboard end of the valve seat 53. Once the proper cracking or opening fuel pressure is adjusted, the valve seat 53** is locked in the adjusted position by suitable means, such as high temperature adhesive (e.g., Loctite® adhesive).

Adjustment of the valve cracking or opening pressure is made after the valve member 50 is attached to the inner injector body 14 and prior to insertion of the inner injector body 14 into the outer injector body 12. Upon insertion of the inner injector body 14 with the precalibrated valve member 50 and valve seat 53 thereon, the inner injector body 14 is sealingly secured in position by a weld joint W or other suitable means.

Metered fuel flows from the tubular valve member 50 into the fuel receiving chamber 51 and then into converging conical chamber 48. The fuel then flows to annular swirl chamber 52 and to annular conical swirl chamber 54 for discharge through orifice 56 past annular fuel discharge lip 58 in the form of a fuel spray cone.

As the fuel spray cone discharges from lip 58, it is intermixed with inner and outer air discharging past inner and outer air discharge lips 60,62, respectively. Inner air discharging from lip 60 enters the upstream end 70 of inner injector body 14 and flows through cylindrical longitudinal bore 72 in the inner injector body 14. Air swirler 21 imparts swirl to the inner air flow in known manner. Outer air discharging past outer air discharge lip 62 enters upstream end 74 of the outer air shroud 22 and flows past swirl vanes 75 and through air swirling chamber 76 for discharge past lip 62. As is known, the air received in the inner injector body 14 and shroud 22 is received from the upstream compressor (not shown) of the gas turbine engine. Typically, outer shroud 22 includes a mounting surface 80 downstream of the compressor so that the fuel and inner and outer air flows are discharged into the internal combustor chamber 84 for burning.

The axial position of valve member 50 along the longitudinal axis A of the injector tip T is located to valve fuel flow in the injector tip in a valve closed manner below a selected minimum fuel pressure (valve cracking pressure) and in a valve metering mode above that fuel pressure with the axial location of the valve member 50 being spaced upstream from discharge end E (fuel discharge orifice 56) a selected sufficient axial distance to allow the desired airblast effects on the fuel stream at the fuel discharge orifice, e.g., air filming or atomization action on the fuel on discharge lip 58 at fuel discharge orifice 56, which is essential for satisfactory performance of an airblast fuel injector, and in addition enhanced fuel distribution around the fuel discharge orifice at low fuel flow rates. In particular, inner air flow past discharge lip 60 must be allowed to film or atomize fuel on lip 58 and also by virtue of low pressure generated in fuel chamber 54 from high velocity inner air flow past lips 60 and 58, to improve distribution of fuel in chamber 54, i.e., annularly therearound, at low fuel flow rates where fuel tends to fill chamber 54 in a non-uniform manner dictated by gravity effects. As a result, the axial location of the valve member 50 is selected upstream from discharge end E as shown to permit inner air flow past lip 60 to perform its intended functions in the airblast injector.

The axial location of the valve member 50, and thus valving of the fuel flow, are also important at higher fuel flow rates where the fuel discharging from the fuel slot has a high tangential velocity component with the fuel stream, as a result, tending to immediately form multiple individual fingers of fuel which, if allowed to be present at lip 58, would interfere with or adversely affect filming (atomization) of the fuel by the inner air stream. To provide a fuel stream more amenable in terms of its velocity and configuration to filming or atomization at lip by inner air flow, the axial location of valve member 50 is spaced sufficiently upstream to allow the tangential velocity component of fuel flow to decrease while the axial velocity component increases to reduce the fuel finger effect and provide a swirling, annular fuel stream discharging from orifice 56 which is satisfactory for filming by the inner air flow from lip 60 as well as outer air flow from lip 62.

Thus, the axial location of the valve member 50 and thus of valving of the fuel flow in the valve closed manner below a selected fuel pressure and valve metering manner above that fuel pressure are effective to reduce fuel vaporization without adversely affecting the airblast operational characteristics of the fuel injector.

In addition to axially locating the valve member 50 in the aforesaid selected axial position, fuel passages downstream from the valve member 50 are sized to facilitate egress of any fuel vapor generated therein, especially during low fuel flow rate operation, and thereby avoid vapor lock in the passages. Of course, the axial positioning of the valve member 50 also shortens the length of the fuel passages downstream thereof so that fuel vapor has a shorter distance to travel for expellation from the discharge end to also avoid vapor lock therein.

Positioning of the valve member 50 in the injector tip T near the fuel discharge orifice substantially reduces fuel vaporization problems and associated vapor lock upstream thereof by maintaining a higher fuel pressure in the injector tip upstream of the spring valve and by shortening the distance between the discharge end E and valve member 50 to facilitate egress of any vapor that might be generated through the relatively uncomplicated and direct-path fuel chambers 48, 52,54 to the combustor chamber.

The injector construction described hereinabove is simple in design with resultant low cost, has improved reliability as no sliding parts with close tolerances are used with less susceptibility to contamination with the valve open and exhibits ease of maintenance sine the inner injector body 14 with the valve member 50 thereon can be replaced by another precalibrated assembly. A lower cost and lighter weight fuel injector is thereby provided for a gas turbine engine. Moreover, the valve cracking pressure is readily adjusted exteriorly of the inner injector body 14 using the adjustably movable valve seat 53.

While certain specific and preferred embodiments of the invention have been described in detail hereinabove, those skilled in the art will recognize that various modifications and changes can be made therein within the scope of the appended claims which are intended to include equivalents of such embodiments.

I claim:

1. A fuel injector tip having a fuel receiving chamber and a fuel discharge orifice downstream of said chamber, a valve seat disposed in the fuel receiving chamber and an arcuate, distensible, tubular valve member for receiving pressurized fuel therein from a source, said tubular valve member having a stationary inlet end in fuel flow communication with the source of fuel and a discharge end disposed in the fuel receiving chamber and cooperatively movable relative to said valve seat in dependence on the pressure of the fuel in said tubular valve member in such a manner as to control discharge of fuel from said tubular valve member to the fuel receiving chamber.

2. The injector tip of claim 1 including an injector body means for forming the fuel receiving chamber.

3. The injector tip of claim 2 wherein said valve seat is adjustably mounted on the injector body means.

4. The injector tip of claim 3 wherein said valve seat is accessible from the exterior of said injector body means for adjustment.

5. The injector tip of claim 1 wherein the valve seat includes a male seating portion configured to be received in said discharge end.

6. The injector tip of claim 5 wherein said seating portion is conical in shape.

7. The injector tip of claim 2 wherein said inlet end is fixedly attached to said injector body means and communicates with a fuel supply inlet in said injector body means.

8. The injector tip of claim 1 wherein said tubular valve member includes an arcuate bend and wall thickness selected to provide a desired valve spring rate for controlling movement of said discharge end relative to said valve seat to provide a desired fuel flow curve.

9. The injector tip of claim 1 wherein said tubular valve member is disposed generally concentric with a longitudinal axis of the fuel receiving chamber.

10. An airblast fuel injector tip, comprising (a) injector body means for forming an inner air chamber having a downstream inner air discharge orifice, an outer air chamber having a downstream outer air discharge orifice and a fuel receiving chamber having a downstream fuel discharge orifice, (b) a valve seat disposed in the fuel receiving chamber and (c) an arcuate, distensible, tubular valve member for receiving pressurized fuel therein from a source, said valve member having an inlet end affixed to the injector body means in fuel flow communication with the source of fuel and a discharge end disposed in the fuel receiving chamber and cooperatively movable relative to the valve seat in dependence on the pressure of the fuel in said tubular valve member in such a manner as to control discharge of fuel from said tubular valve member to said fuel receiving chamber.

11. The injector tip of claim 10 including an inner injector body for forming the fuel receiving chamber.

12. The injector tip of claim 11 wherein said valve seat is adjustably mounted on the inner injector body.

13. The injector tip of claim 12 wherein said valve seat is accessible from the exterior of said inner injector body for adjustment.

14. The injector tip of claim 10 wherein the valve seat includes a male seating portion configured to be received in said discharge end.

15. The injector tip of claim 14 wherein said seating portion is conical in shape.

16. The injector tip of claim 11 wherein said inlet end is fixedly attached to said inner injector body and communicates with a fuel supply inlet in said inner injector body.

17. The injector tip of claim 10 wherein said tubular valve member includes an arcuate bend and wall thickness selected to provide a desired valve spring rate for controlling movement of said discharge end relative to said valve seat to provide a desired fuel flow curve.

18. The injector tip of claim 10 wherein said tubular valve member is disposed generally concentric with a longitudinal axis of the fuel receiving chamber.

19. A method for controlling fuel flow in a fuel injector tip comprising:

(a) disposing an arcuate, distensible, tubular valve member in a fuel receiving chamber of the fuel injector tip with an inlet end of said valve member fixed in a position for receiving pressurized fuel from a source and with a discharge end of said valve member cooperatively positioned relative to a valve seat disposed in said fuel receiving chamber, and (b) introducing pressurized fuel into said tubular valve member from the source at a pressure to cause distention of said tubular valve member and movement of said discharge end relative to said valve seat in such a manner as to control fuel discharge from said tubular valve member to said fuel receiving chamber.

* * * * *

UNITED STATES PATENT AND TRADEMARK OFFICE

CERTIFICATE OF CORRECTION

PATENT NO. : 4,938,417

DATED : July 3, 1990

INVENTOR(S) : Robert M. Halvorsen

It is certified that error appears in the above-identified patent and that said Letters Patent is hereby corrected as shown below:

Column 6, line 34, delete "sine" and insert --since-- therefor.

Column 7, line 22, before "fuel" insert --an annular--; and after "chamber" insert --between the inner and outer air chambers and--

Signed and Sealed this

Sixth Day of August, 1991

*Attest:*

*Attesting Officer*

HARRY F. MANBECK, JR.

*Commissioner of Patents and Trademarks*